US008201351B2

(12) United States Patent
Ganan Calvo

(10) Patent No.: US 8,201,351 B2
(45) Date of Patent: Jun. 19, 2012

(54) PROCEDURE AND DEVICE FOR THE MICRO-MIXING OF FLUIDS THROUGH REFLUX CELL

(76) Inventor: Alfonso Miguel Ganan Calvo, Seville (ES)

( * ) Notice: Subject to any disclaimer, the term of this patent is extended or adjusted under 35 U.S.C. 154(b) by 1086 days.

(21) Appl. No.: 11/793,622

(22) PCT Filed: Jan. 16, 2006

(86) PCT No.: PCT/ES2006/000014

§ 371 (c)(1),
(2), (4) Date: Feb. 19, 2008

(87) PCT Pub. No.: WO2006/089984

PCT Pub. Date: Aug. 31, 2006

(65) Prior Publication Data

US 2008/0271350 A1 Nov. 6, 2008

(30) Foreign Application Priority Data

Jan. 17, 2005 (ES) ..... 200500112
Apr. 18, 2005 (ES) ..... 200500981

(51) Int. Cl.
*D06F 75/22* (2006.01)
*B05B 1/00* (2006.01)

(52) U.S. Cl. ..... 38/77.5; 261/78.1; 239/8; 239/338; 239/424

(58) Field of Classification Search ..... 38/74–77.83; 137/888, 893, 896; 417/151; 239/338, 433, 239/434, 8, 424; 261/78.1
See application file for complete search history.

(56) References Cited

U.S. PATENT DOCUMENTS

| | | | | |
|---|---|---|---|---|
| 1,140,548 | A * | 5/1915 | Vogelsang | 366/163.2 |
| 3,822,217 | A * | 7/1974 | Rogers | 261/78.1 |
| 5,209,407 | A * | 5/1993 | Farrington | 239/491 |
| 5,868,322 | A | 2/1999 | Loucks, Jr. et al. | |
| 5,884,846 | A | 3/1999 | Tan | |
| 6,190,034 | B1 * | 2/2001 | Nielsen et al. | 366/336 |
| 6,935,056 | B2 * | 8/2005 | Milanese | 38/77.5 |
| 7,000,342 | B2 * | 2/2006 | Chen | 38/77.8 |
| 7,883,026 | B2 * | 2/2011 | Micheli | 239/8 |
| 2002/0092918 | A1 * | 7/2002 | Anderson et al. | 239/8 |

FOREIGN PATENT DOCUMENTS

| | | |
|---|---|---|
| WO | 00/76673 | 12/2000 |
| WO | 03/095097 | 11/2003 |

* cited by examiner

*Primary Examiner* — Ismael Izaguirre
(74) *Attorney, Agent, or Firm* — Waddey & Patterson PC; Matthew C. Cox

(57) ABSTRACT

Procedure and device for the micro-mixing of miscible or immiscible fluids through reflux cell, produced by the invasion of one of the fluids going upstream into the feeding tube of the other fluid. This tube is closed and has a tube exit which is placed opposite an area of confluence where the exiting flow of the intercepted fluid meets an approximately perpendicular current of invading fluid, which is radially and centripetally directed to the axis of this exiting flow. The product is released outside through an exit orifice. The edges of the tube exit and the exit orifice are opposite each other and separated by an axial gap; and the penetration of this reflux cell into the feeding tube is regulated by controlling the velocity of the fluid. An application of the invention is the ironing with a steam-aided water spray of drops smaller than 200 microns.

20 Claims, 3 Drawing Sheets

PROCEDURE AND DEVICE FOR THE MICRO-MIXING OF FLUIDS THROUGH REFLUX CELL

DESCRIPTION OF THE INVENTION

1. Object of the Invention

The invention relates to a method and device for the micro-mixing of miscible or immiscible fluids using a reflux cell which is produced by the counter-current invasion by one of the fluids which penetrates upstream in the tube used to supply the other fluid. Said tube is closed and equipped with a discharge outlet which is positioned opposite a confluence area in which the outflow of the intercepted fluid is found which an essentially-perpendicular current of invading fluid that is directed radially and centripetally towards the axis of said outflow. The product is discharged freely to the exterior though an outlet orifice, the edges of the discharge outlet and the exit orifice being disposed opposite one another and separated by axial gap. through an exit orifice. The edges of the tube exit and the exit orifice are opposite each other and separated by an axial gap; and the penetration of this reflux cell into the feeding tube is regulated by controlling the velocity of the fluid. An application of the invention is the ironing with a steam-aided water spray of drops smaller than 200 microns.

2. State of the Art

The production of multiphase systems at a small scale is very interesting in many applications in pharmacy, food, agronomic and scientific industries. Among these multiphase systems we can find emulsions, foams or aerosols. Their production by purely fluid dynamic processes, particularly by pneumatic means, allows very different applications and developments in industry, technology, science and daily life. Aerosols have been used in various technological fields, particularly as a means to treat respiratory diseases through nebulization of liquid medicines. The administration of medicines through inhalation using aerosols allows to obtain appropriate concentrations of medicine in the respiratory system, minimizing side effects. In the same way, applications in the agronomic field are very well known, such as spraying pest-control substances as a part of a treatment of protection against insects. To do this, we use manual or automatic equipments which allow a targeted delivery and the capacity to control the size of drops, whose diameter usually varies between 100 and 500 microns. When drops sizes are inferior, between 50 and 100 microns, we usually use the term "nebulization": when applying pest-control substances, it increases not only the capacity of flotation of the preparation but also the covered area when deposition of drops takes place.

There are several technological principles that could be applied to mixing (in the cases when the confluent phases are molecularly miscible) or the interpenetration of one or more phases. Some precedents based on purely fluid dynamic means are stated bellow. The technology called Flow Focusing (FF) (Gañán-Calvo 1998, *Physical Review Letters* 80, 285), through the use of a special geometry, uses pneumatic means in order to create micro-jets of liquid which lead to the formation of drops of a very small and substantially homogeneous size after passing through the exit orifice. This latest technology is able either to create micro-jets of liquid through another liquid instead of gas, or to generate micro-jets of gas inside a liquid (the same liquid or another different liquid used as an focusing liquid, that is to say, acting as the gas does in the pneumatic process), so that micro-bubbles of homogeneous sizes are created.

Later, the patent WO 0076673 (D1) suggested a configuration of flow, called violent flow focusing; As a marked difference with FF, the focusing gas has an essentially radial and centripetal flow (diaphragm-flow), concentrically directed in a thin layer which intercepts the exiting liquid in a surface of flow which is transversal to the axis of liquid movement. As it is explained in D1, the gas comes from a pressure camera, and the intense interaction produced between the liquid phase (whose movement is essentially axial) and the gaseous phase (radially directed) creates an immediate transference of a quantity of movement. As it is described in D1, however, the liquid comes outside as a jet. Moreover, this patent also states that the drops size has a very small dependence on the flow rate of the atomized liquid, at least within the parametric range of flow rates claimed. It is also important to emphasize that in D1 a relation between the average diameter of drops d and system parameters is claimed. Such system parameters are: the liquid flow rate Q, the applied pressure ΔP, and the physic properties of the liquid: density ρ and surface tension σ), given by:

$$d/d_o \approx (Q/Q_o)^{1/5} \quad (1)$$

where $d_o=\sigma/\Delta P$, and $Q_o=(\sigma^4/(\rho\Delta P^3)^{1/2}$. In D1 it is claimed that the liquid comes out through the exit orifice as a jet; if the diameter of this jet has the following expression (A. M. Gañán-Calvo 1998, *Physical Review Letters* 80, 218):

$$d_j \approx (Q/Q_o)^{1/2} d_o \quad (2)$$

then, the expression (1) would be perfectly justified through the pattern of turbulent mixture (in an area after the exit of the orifice) by Kolmogorov-Hinze (R. Shinnar, 1961, *Journal of Fluid Mechanics* 10, 259). Indeed, this theory states that the diameter of the drops produced by the turbulent broke is related to the macroscopic scale of the flow, which is $d_j$, according to the following expression:

$$d/d_j \approx (d_o/d_j)^{0.6} \quad (3)$$

Combining the expressions (2) and (3) we obtain the expression (1). Data which have been stated in D1 agree very well with law (1), which agrees with the presence of the jet (which can be detected also through visual means). On the other hand, some geometric restrictions of the device are also stated so that the working of the system works according to what it is declared.

More recently, the application of Spanish patent number P200402333 (D2) whose title is "Device and process for the pneumatic atomization of liquids through the implosive flow of gas" describes devices and processes to atomize a liquid using a similar configuration of the present invention, restricted to the case of a circular tube exit and being the liquid phase surrounded by the gaseous phase while they go through the exit orifice. It describes also a variety of possible configurations to drive the liquid through the gaseous phase, which can be a vapour.

As a difference with those patents above, the invention described herein adds a modality of mixing that, on the one hand, allows the interaction of two or more arbitrarily chosen phases (it is not essential the restriction to a liquid jet in the centre with a gaseous current around); on the other hand, it is not based on the fragmentation of a jet that has been emitted by the central tube, but on a new principle: the invasion of this feeding tube by an invading stream coming from the external fluid. Therefore, the essential feature of the described process and device is the production of a reflux cell, where scales of turbulence are created ensuring in this way a closer interaction between the confluent phases. Therefore, the differences with patent D1 are (i) there is not a jet of one of the phases surrounded by the other phase, passing through an exit orifice, (ii) the geometric restrictions in D1 can not be applied to the present invention, and (iii) when using the present invention as a nebulizers of liquids, the obtained sizes of drops are much smaller (in some cases even five times smaller) than those described in D1.

Regarding steam-aided ironing with water spray, the first steam iron appeared in the middle sixties (U.S. Pat. No. 3,248,813). It consisted of an iron with a heat source inside generating a steam current which goes through a filter or diffuser as humidity drops. Another invention related to this one is an iron incorporating a water inlet device which conveys a water flow to a nebulizer used as a process of steam aided ironing (WO9800597), where the steam generator can be situated in an independent stand or inside the iron (WO9925915) and can be automatically filled. There are also previous works which use a system to generate the steam that will be conveyed to the iron through some pipes (WO02070812).

Unlike those previous inventions, the present invention includes a pneumatic nebulizer, where drops are generated from the turbulent mixture with water steam. This steam can either be directly generated through independent systems (either previous or not) of heat generation (e.g. electric), or either by means of the use of heat coming from the piece used to press while ironing. A way to do it, it would be by means of making the line of water expected to become steam pass through the area around this piece so that along its way the absorbed heat be enough to cause vaporization. The high velocity of the water at the moment of coming out of the spray caused by the methodology described above improves the features of ironing, in contrast to other methods.

DESCRIPTION OF THE INVENTION

The object of the invention is a device of combination of phases for the mixing in the case of miscible fluids and for the production of emulsions, aerosols and microfoams in the case of immiscible fluids, by means of the creation of a reflux cell produced by the upstream invasion of one of the fluids (the one with lower density, referred to hereafter as invading fluid), that enters upstream into the feeding tube of the other fluid (the one with a higher density, referred to hereafter as intercepted fluid). This feeding tube is closed and has an exit; this tube exit is situated just opposite to an area of confluence where the exiting flow of the intercepted fluid meets an approximately perpendicular stream directed radially and centripetally to the axis of this exiting flow; the result of the interaction of both phases, mainly produced in this reflux cell, is freely released through an exit orifice that has approximately the same size than the tube exit; the edges of the tube exit and the exit orifice are in front of each other and separated by an axial gap; the penetration of this reflux cell in the feeding tube is regulated by controlling the velocity of the invading fluid in the confluence area, that should be at least twice higher and preferably at least five times higher than the velocity of the intercepted fluid in the feeding tube; the relation between velocities is obtained by means of an appropriate choice of the mass flow ratio of both phases, and also by means of the choice of the axial gap, that should be less than the half, and preferably inferior to a quarter of the diameter of the exit orifice.

Another variant of the invention is a device of combination of phases where the invading fluid is compound, consisting of several streams conformed by differentiated phases that interact with the current of the intercepted fluid in the reflux cell.

There is also described a device of combination of phases where the fluids are molecularly immiscible.

More specific forms of the invention lead to devices where the average inertia per unit volume of any of the phases at the confluence area and at the passage section of the exit orifice is at least twenty times (preferably one hundred times) higher than the average value per unit volume of the forces that are caused at the current due to the viscosity of the fluids at the confluence area and at the passage section of the exit orifice.

In other variant of the invention, the feeding tube of the intercepted fluid has a preferably circular section, as well as its tube exit and the exit orifice. The said tube exit is within a plane that is perpendicular to the symmetry axis of the tube; and that plane is parallel to the plane containing the exit orifice, and there exists an axial gap between both planes; the difference between the diameters of both the exit orifice and the tube exit is inferior to 20% of the largest diameter, and the centres of the tube exit and the exit orifice are aligned with a maximum error of 20% of the largest diameter.

Other additional modality is based in the fact that the invading fluid (or fluids) meet at the exit of the feeding tube of the intercepted fluid through one or more apertures perpendicularly positioned to face the axis of this tube, so that these apertures border on the tube exit on one side and on the exit orifice on the other side. The exit orifice is situated in front of the tube exit of the tube and the total area of these apertures is between 0.2 and 1.5 times, preferably between 0.5 and 1 time the area of the exit orifice.

In particular, a device for the mixing is described in this invention which makes two phases meet, being the densest phase a liquid and the least dense a gas, so that the gas to liquid mass flow ratio is between 0.01 y 10000, preferably between 0.05 y 200.

A preferential use of the described devices is the introduction of samples in atomic spectroscopy through this process; the intercepted fluid is a liquid phase containing samples to be characterized by optic or mass atomic spectroscopy, and the invading fluid is a gas, preferably argon.

On the other hand, the object of the invention is also a process of combination of phases for the mixing in the case of miscible fluids, and for the production of emulsions, aerosols and micro-foams in the case of immiscible fluids, based on the use of the device described above.

Another object of the invention is a device of ironing or "iron", that consists of a pneumatic nebulizer to generate an aerosol of very thin drops by means of the mixing of liquid water and steam following the described configurations. This device is characterized by the fact that the invading fluid is steam generated through the application of heat to a current of liquid water, which is in fact the intercepted fluid. This heat used to vaporize water can come from the piece used to press the fabric in order to iron it. The generated drops impact against the fabric and their size can be controlled in order to improve the results of the ironing. The device can work with a mass flow rate of steam inferior to the half of the mass flow rate of the liquid water. This system allows a high saving of energy when compared with the conventional systems of ironing, which need much more energy to produce a complete vaporization of the liquid current. On the other hand, this system uses less energy since the proposed device needs for a fixed water flow rate the iron ejects only the vaporization of one fraction of it, reducing in this way energy consumption. Likewise, penetration of humidity in the fabric, and therefore effectiveness of the ironing, are increased thanks to the higher inertia of the aerosol, the small size of its drops and the high velocity of drops at the moment of coming out of the spray.

DESCRIPTION OF THE FIGURES

Description of the figures captions

EXAMPLES OF THE CARRYING OUT OF THE INVENTION

Example 1

System of Pneumatic Atomization of Liquids

Figure 1:
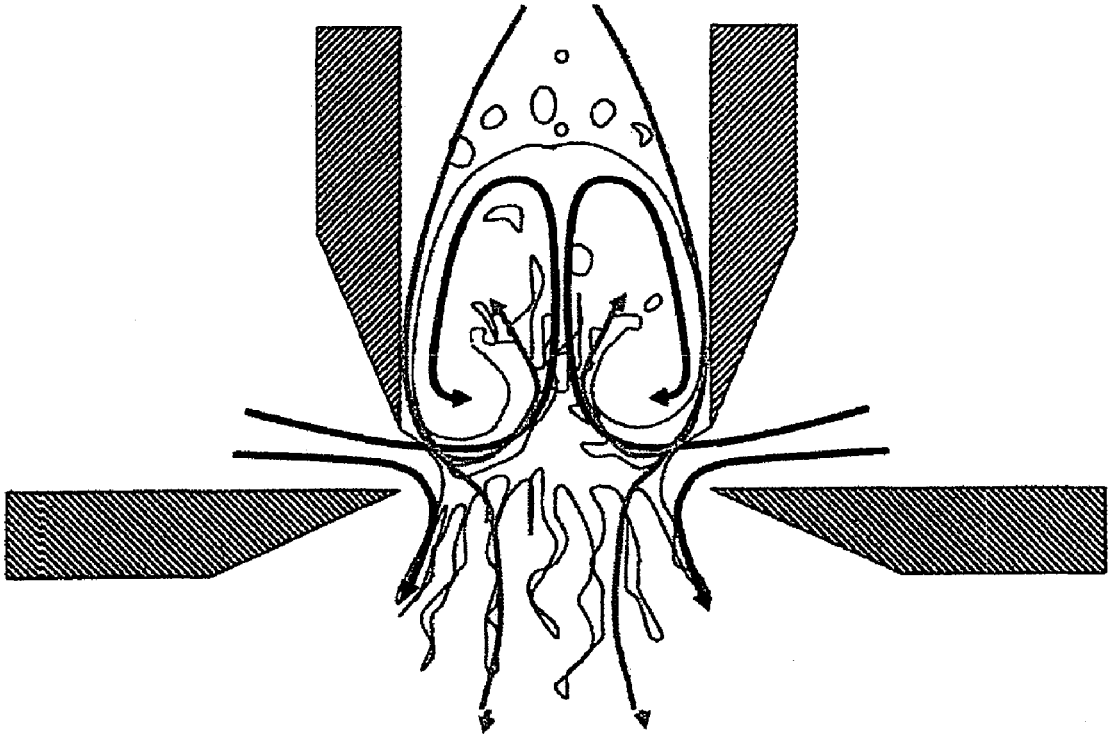
FIG. 1. Axi-symmetric configuration of the mixing device of the present invention as a liquid nebulizer. Grey arrows: Liquid to be atomized. Black arrows: Atomization gas.

By means of the configuration shown in FIG. 1, with symmetry of revolution, the feeding tube of the liquid has a circular section and an interior diameter D. The said tube is inside a pressurized camera containing a gas which has one or more feeding inlets. The feeding tube exit is sharp-edged, as shown in the figure, and it is in front of another circular orifice with a diameter D situated on one of the walls of the camera, so that the planes containing the exit orifice of the camera and the exit of the feeding tube are parallel and separated by a distance H. This distance H is smaller than D/2, preferably smaller that D/4, so that the lateral ring-shaped section between the tube exit and the exit orifice has a passage area which is similar to the area of the exit orifice.

Figure 2:
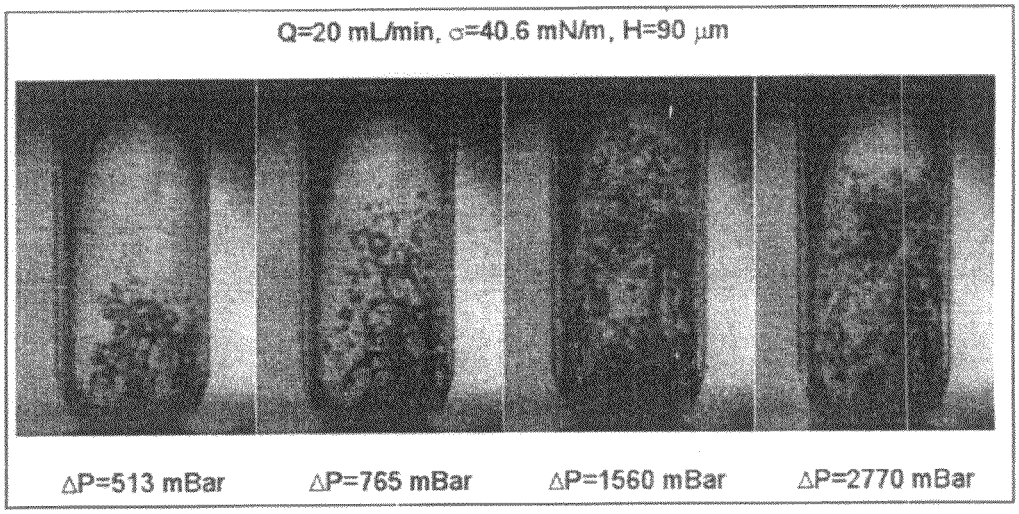
FIG. 2. Four examples of mixing inside the tube, at the area around the tube exit (high speed pictures taken with a shutter speed of 0.1 microsecond, using a 4 Quick high speed video camera by Stanford Computer Optics), for the case of atomizing a liquid by means of gas and using an axi-symmetric configuration. Observe the formation of microscopic scales, bubbles of very different sizes and drops. The used liquid is water with 0.1% of Tween 80. The value for H is the distance between the exit of the feeding tube of the liquid and the exit orifice.
Figure 3:
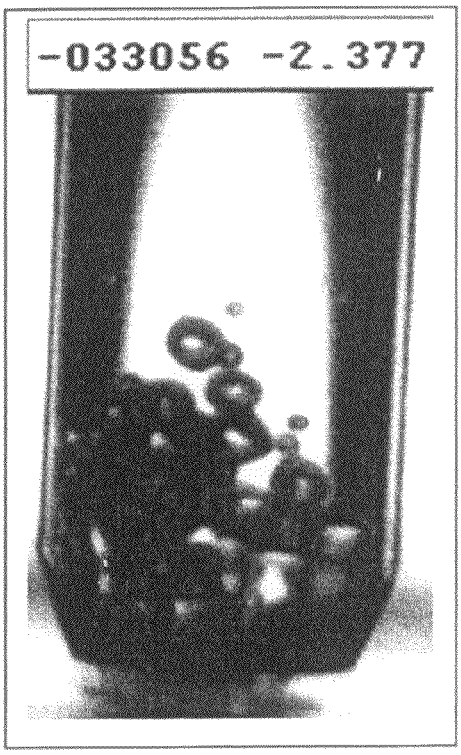
FIG. 3. Example of mixing inside the tube in the case of atomizing a liquid by means of gas and using an axi-symmetric configuration. In this case, the used liquid is 20° C. pure water, whose overpressure is $\Delta P=2500$ millibars and whose liquid flow rate is Q=10 mL/min.

Due to the fact that the shape of the exit of the feeding tube of the liquid is sharp-edged, the lateral ring-shaped passage section of the gas already described makes easier a prompt gas release, with little or even no loses by friction. Consistently, the pressurized gas inside the camera will be released through the said section with the highest velocity the essentially adiabatic expansion allows (for a gap of pressures $\Delta P$ between the camera and the outside) up to the intermediate area situated between the tube exit and the exit orifice of the camera, as FIG. 1 shows. In this intermediate area a complex non-stationary distribution of pressures is produced as a consequence of: (i) the radial collapse at a high velocity of gas towards the axis of symmetry of the tube, causing a local increase of pressure at the area around the said axis of symmetry, and (ii) the liquid release through the tube being the liquid volume flow rate Q. The rise of local pressure at the area around the symmetry axis of the tube causes penetration of gas upstream the tube in the shape of a vertical jet that immediately opens up and becomes an area of toroidal vorticity ("mushroom" configuration) inside the tube, making its symmetry axis meet that of the tube, at the area around the tube exit (see FIG. 1). In this area a very turbulent movement takes place, generating microscopic mixing scales, bubbles and microscopic drops, and causing a violent mixing with the liquid coming from the tube (see FIGS. 2 and 3). In FIG. 3 we can observe how the liquid comes out at a high velocity from the tube exit in the shape of numerous thin liquid ligaments, before they pass through the exit orifice. This is an essential difference of the present invention in relation to the previous ones (D1 and D2).

Example 2

System of Liquids Mixing

By means of the configuration shown in FIG. 1, with symmetry of revolution, the feeding tube of the liquid has a circular section and an interior diameter D. The said tube is inside a pressurized camera containing another liquid which has one or more feeding inlets. The feeding tube exit is sharp-edged, as shown in the figure, and it is in front of another circular orifice with a diameter D situated on one of the walls of the camera, so that the planes containing the exit orifice of the camera and the exit of the feeding tube are parallel and separated by a distance H. This distance H is smaller than D/2, preferably smaller that D/4, so that the lateral ring-shaped section between the tube exit and the exit orifice has a passage area which is similar to the area of the exit orifice.

Figure 4:
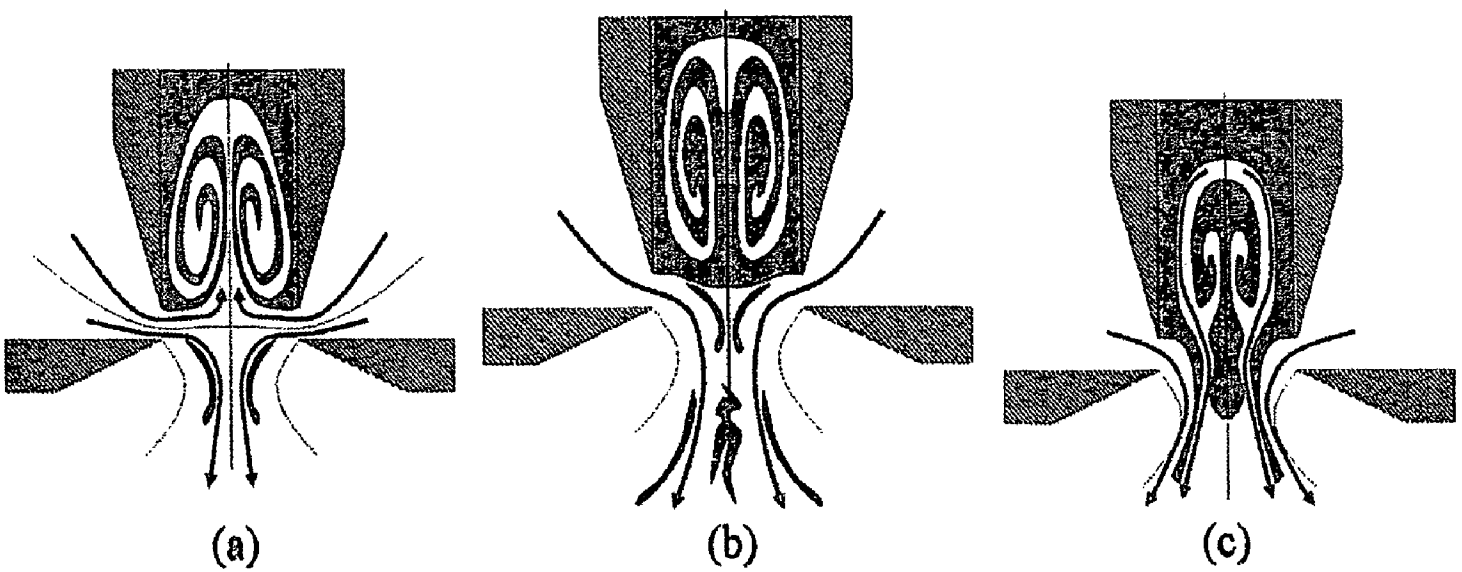
FIG. 4. Process of dynamic mixing at the area of confluence of phase 1 (denser) and phase 2 (less dense) and reflux to the phase 1 feeding tube, with three characteristic steps: (a) Formation of a stagnation point at the velocity field of fluid 2 between the tube exit and the exit orifice. The pressure begins to increase at the moment of going out of the tube. (b) Collapse of the inlet of the fluid 2 towards the tube by accumulation of fluid 1 at the tube exit. (c) Release of the accumulated fluid 2 together with fluid 1. Decrease of pressure at the tube exit.

In this case where two liquid phases are mixed up, a possible flow pattern presenting three more or less cyclical moments is described in FIG. 4.

The invention claimed is:

1. A device for forming an aerosol of droplets, comprising:

a feeding tube having a feeding tube opening, the feeding tube including a feeding tube axis; and a pressure chamber surrounding the feeding tube opening, the pressure chamber including a pressure chamber exit orifice positioned downstream of the feeding tube opening, wherein the feeding tube opening is axially offset from the pressure chamber exit orifice by an axial gap;

wherein the device is configured to form a reflux cell of the first and second fluids inside the feeding tube when a first fluid is forced through the feeding tube and a second fluid is forced through the pressure chamber toward the pressure chamber exit orifice, and wherein the reflux cell facilitates turbulent mixing of the first and second fluids inside the feeding tube.

2. The device of claim 1, further comprising:

the axial gap including an axial gap length; and the pressure chamber exit orifice including an exit orifice diameter, wherein the ratio of the axial gap length to the exit orifice diameter is less than about 0.25.

3. The device of claim 2, wherein:

the ratio of the axial gap length to the exit orifice diameter is less than about 0.175.

4. The device of claim 2, wherein:

the ratio of the axial gap length to the exit orifice diameter is less than about 0.1.

5. The device of claim 1, further comprising:

one or more apertures positioned in the axial gap substantially facing the feeding tube axis, each aperture bordering the feeding tube opening at one axial end and bordering the pressure chamber exit orifice at the opposite axial end, wherein the ratio of the total aperture surface area of all apertures to the area of the pressure chamber exit orifice is between about 0.05 and about 1.5.

6. The device of claim 5, wherein the ratio of the total aperture surface area to the area of the pressure chamber exit orifice is between about 0.1 and about 1.0.

7. A method of forming an aerosol of droplets, comprising:

(a) providing a feeding tube having a feeding tube opening, the feeding tube including a feeding tube axis, a pressure chamber surrounding the feeding tube opening, the pressure chamber defining a pressure chamber exit orifice positioned downstream of the feeding tube opening;

(b) supplying a first flow of a first fluid through the feeding tube toward the feeding tube opening;

(c) supplying a second flow of a second fluid toward the feeding tube axis between the feeding tube opening and the pressure chamber exit orifice, wherein the second fluid intercepts the first fluid, travels upstream toward the feeding tube opening, and enters the feeding tube through the feeding tube opening;

(d) forming a reflux cell inside the feeding tube upstream of the feeding tube opening, wherein the first and second fluids undergo turbulent mixing in the reflux cell; and (e) ejecting the first fluid from the reflux cell through the pressure chamber exit orifice.

8. The method of claim 7, further comprising:

controlling the velocity of the first and second fluids such that the velocity of the second fluid is at least 10% higher than the velocity of the first fluid at the location where the second fluid intercepts the first fluid.

9. The method of claim 8, wherein:

the velocity of the second fluid is at least five times the velocity of the first fluid at the location where the second fluid intercepts the first fluid.

10. The method of claim 7, wherein:

the feeding tube opening is separated from the pressure chamber exit orifice by an axial gap having an axial gap length;

the pressure chamber exit orifice includes an exit orifice diameter; and the ratio of the axial gap length to the exit orifice diameter is less than about 0.25.

11. The method of claim 10, wherein:

the ratio of the axial gap length to the exit orifice diameter is less than about 0.17.

12. The method of claim 10, wherein:

the ratio of the axial gap length to the exit orifice diameter is less than about 0.1.

13. The method of claim 7, wherein:

the axial gap forms an aperture substantially facing the feeding tube axis, wherein the aperture borders the feeding tube opening at one axial end and borders the pressure chamber exit orifice at the other axial end;

the pressure chamber exit orifice is situated downstream of the feeding tube opening; and the ratio of the total aperture surface area to the area of the pressure chamber exit orifice is between about 0.05 and about 1.5.

14. The method of claim 13, wherein the ratio of the total aperture surface area to the area of the exit orifice is between about 0.1 and about 1.0.

15. The method of claim 7, further comprising:

ejecting the first fluid from the reflux cell; and breaking the first fluid into droplets following ejection of the first fluid from the reflux cell.

16. The method of claim 7, further comprising:

forming a plurality of bubbles of the second fluid in the reflux cell.

17. A method of forming an aerosol, comprising:

(a) providing a device including a feeding tube having a feeding tube opening, the feeding tube positioned in a pressure chamber, the pressure chamber including a pressure chamber exit orifice substantially aligned with the feeding tube opening downstream of the feeding tube opening;

(b) forcing a first fluid through the feeding tube;

(c) forcing a second fluid through the pressure chamber such that a first portion of the second fluid travels through the exit orifice and a second portion of the second fluid travels upstream through the feeding tube opening into the feeding tube;

(d) forming a region of toroidal vorticity between the first and second fluids inside the feeding tube; and (e) ejecting the first fluid from the device through the pressure chamber exit orifice.

18. The method of claim 17, wherein:

the first fluid is a liquid; and the second fluid is a gas.

19. The method of claim 17, further comprising:

forming a plurality of ligaments of the first fluid extending from the feeding tube opening toward the pressure chamber exit orifice.

20. The method of claim 19, further comprising:

breaking the plurality of ligaments of the first fluid into a plurality of droplets.

* * * * *